United States Patent [19]

Evans

[11] 4,100,529

[45] Jul. 11, 1978

[54] ROAD HAZARD WARNING SYSTEM, INDICATING SPECIFIC HAZARD

[75] Inventor: Edgar J. Evans, Hillsdale, Mich.

[73] Assignee: Mews, Inc., Toledo, Ohio

[21] Appl. No.: 722,691

[22] Filed: Sep. 13, 1976

[51] Int. Cl.[2] ..... G08G 1/00

[52] U.S. Cl. ..... 340/32; 325/55; 325/64; 340/384 E

[58] Field of Search ..... 340/32, 33, 384 E; 325/43, 117, 364, 55, 64, 466, 312

[56] References Cited

U.S. PATENT DOCUMENTS

| | | | |
|---|---|---|---|
| 3,072,898 | 1/1963 | Schmertz | 340/384 E |
| 3,094,682 | 6/1963 | Brosh et al. | 340/32 |
| 3,132,330 | 5/1964 | Donner | 340/384 E |
| 3,233,217 | 2/1966 | Bost | 340/33 |
| 3,283,297 | 11/1966 | Pfennighausen et al. | 340/32 |
| 3,284,707 | 11/1966 | Clinton | 340/384 E |
| 3,325,578 | 6/1967 | Park | 340/384 E |
| 3,492,581 | 1/1970 | Wisniewski | 340/32 |
| 3,943,507 | 3/1976 | Neal et al. | 340/384 E |
| 3,995,268 | 11/1976 | Ferrari | 340/384 E |

*Primary Examiner*—John W. Caldwell, Sr.
*Assistant Examiner*—James J. Groody

[57] ABSTRACT

System for warning vehicle drivers of the proximity of a road hazard. Each road hazard, moving emergency vehicles for example, have associated with them a radio frequency signal transmitter which transmits a pulse length coded signal which is unique for each hazard. Private vehicles have receivers which are responsive to the set radio frequency. When such a vehicle is within range of the road hazard warning transmitter, a light in the vehicle will flash on and off in synchronism with the pulse length coded signal. In addition, this signal drives a sound generator on and off in synchronism with the flashing light producing a coded audio signal. The Radio frequency pulse length coded signal is modulated at an audio frequency in the receiver without disturbing the pulse length code of the radio frequency signal. This then allows a human observer to hear the pulse length code as a coded audio signal.

3 Claims, 5 Drawing Figures

ROAD HAZARD WARNING SYSTEM, INDICATING SPECIFIC HAZARD

BACKGROUND OF THE INVENTION

This invention generally relates to systems for warning the drivers of vehicles of a road hazard. More particularly, this invention relates to such a system wherein a class of vehicle, such as an emergency vehicle, broadcasts a radio signal at a fixed frequency for receipt by radio receiving units in private vehicles. Specifically, this invention relates to such a system in which each class of road hazard broadcasts a differently coded signal at the same frequency and activates warning devices in the private vehicles.

Emergency vehicles such as police cars, fire engines and ambulances have the right-of-way while responding to calls for assistance. In order to signal their approach to the public, such vehicles have traditionally used sirens and flashing lights. When a motorist in a private vehicle is alerted by the sound or light, he is required to yield the right-of-way. However, the problem of alerting the public by the use of such devices has become acute in the past few years. More and more people drive with their automobile windows up year round as automobile air conditioning has become commonplace. In addition, automobile music systems have become extremely popular and efficient. The net result is that the average driver receives very little audio input from the outside environment, thus rendering the use of sirens ineffectual. To further complicate the matter, flashing lights have never been especially effective in congested urban areas where lines of sight tend to be relatively short. In addition, despite the questionable effectiveness of sirens as warning devices, deaf persons in many states are under serious driving limitations because they cannot hear sirens. The net result of these factors has been a serious upsurge in collisions involving emergency vehicles and a general slow down in the ability of such vehicles to quickly respond to a call. Emergency vehicles are only a part of the problem faced by drivers without adequate warning. The general term road hazards can be used to include such problems as emergency vehicles, construction sites, railway trains, school zones and others.

Systems of this type are not unknown in the prior art and the following U.S. Patents are believed to illustratethe state of the art; U.S. Pat. Nos. 3,233,217; 3,293,600; 3,371,278; 3,441,858; 3,673,560; 3,760,349; 3,772,641; 3,854,119; and 3,909,826. None of the prior art systems have met with success, the major problem being one of complexity in dealing with a plurality of road hazards and the resulting cost of the entire system. For example, the system of U.S. Pat. No. 3,233,217 requires a very complex receiver to distinguish the multiple tones transmitted from ultiple hazard sources. Further, a false trigger signal gives no indication of being such.

I have solved these problems by my invention of a relatively simple system which requires only a very simple receiver. Each road hazard has assigned to it a unique pulse length coded identification signature. Police cars may use a dot-dot code, fire trucks a dot-dash-dot and construction projections a dash-dash, for example. Thus, each hazard has associated with it a transmitter which will transmit only one coded signal. The receivers in private vehicles are set to receive the common radio frequency carrier signal. The coded pulses, when received, are further modulated to cause a light to flash on and off in the code pattern and an audible signal to sound in the same code pattern. Thus, any coding complexity is built into the transmitters, while all the receivers may be identical yet respond to a plurality of different source signals.

SUMMARY OF THE INVENTION

This invention is a warning system which will warn vehicle drivers of the presence of road hazards. In this invention, each particular road hazard has associated with it a transmitter of radio frequency signals. Each hazard has assigned to it a unique pulse length coded signal that modulates the basic radio frequency signal. Receivers carried by vehicles in the area of the hazard are tuned to receive the radio frequency signal which includes the pulse length coded signal. An audio frequency sound generator means connected with the receiver means further modulates the pulse length coded signal at an audio frequency without disturbing the pulse length code. A visible light emitting means is connected to the output of the audio sound generator means and flashes in synchronism with the pulse length coded signal. An audible sound emitting means is connected in series with the visible light emitting means and sounds an audible warning at the frequency set by the audio sound generator means and in synchronism with the pulse length coded signal from the transmitter means.

DETAILED DESCRIPTION OF THE DRAWINGS

Figure 1:
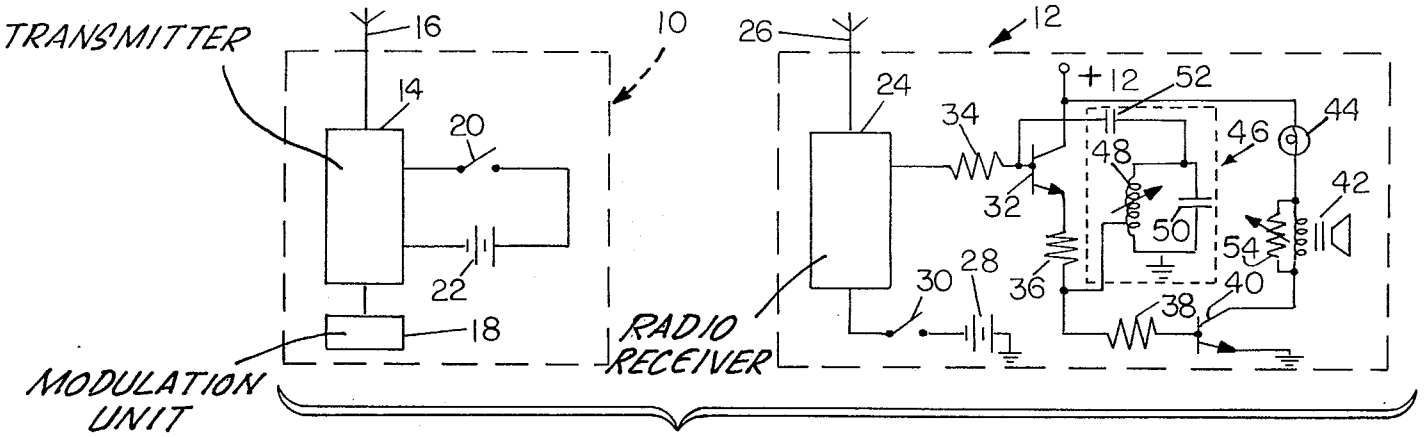
FIG. 1 is a schematic diagram of the basic apparatus of the present invention.

FIG. 1 illustrates the apparatus of the present invention. The cooperation of at least two components are required: a radio signal transmitting unit 10 and a radio signal receiving unit 12. The transmitting unit 10 may be carried by an emergency vehicle or placed adjacent a construction site and includes a basically conventional radio transmitter 14 having associated therewith a transmitting antenna 16. The transmitter 14 has connected to it an identification code modulation unit 18. The modulation unit 18 is pre-set depending upon the signal to be broadcast by the transmitter 14. The transmitter 14 is a common unit which transmits a radio frequency (RF) signal, modulated at a specific tone frequency. The same transmitter 14 may be used to uniquely identify a plurality of situations by providing different modulation units 18. The modulation unit 18 is designed to turn the tone modulated RF signal on and off in a specific pattern.

Figure 2:
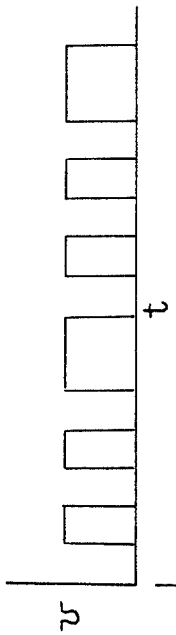
FIGS. 2, 3 and 4 illustrate different pulse length coded signals to identify individual road hazards.
Figure 3:
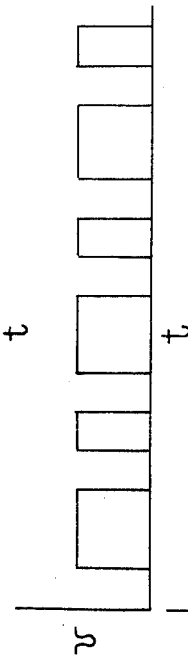
Figure 4:
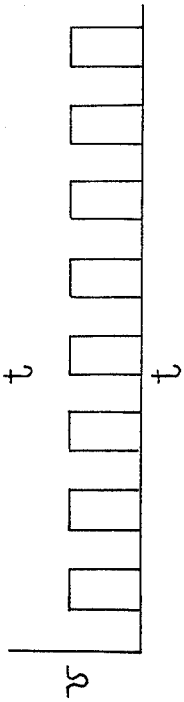

FIGS. 2, 3 and 4 give wave form examples of the modulation of the RF signal from the transmitter 14 by the modulation unit 18. FIG. 2 shows a pattern of two short pulses followed by one long pulse. This pattern could indicate the presence of a police car. The wave forms of FIG. 3 could identify an ambulance and show a pattern of alternating long and short pulses. The presence of a construction site could be given by the repeating series of short pulses, as shown in FIG. 4. The wave forms of FIGS. 2, 3 and 4 could be generated by having multivibrators or other fixed sequence devices set the pulse length coding pattern of the modulation unit 18. In this case, each application area for the transmitting unit 10 (i.e. police, fire, ambulance, construction, etc.) would have its own specific modulation unit 18 which must be installed. As an alternative, the transmitting unit 10 could be identical for all applications with the modulation unit 18 having built in a variable element to allow adjustment of the transmitted wave forms to conform to the code for a specific application.

The transmitting unit 10 may be powered in several ways, depending on where it is used. In mobile applications, the vehicle battery may provide the power. In construction site usage, external battery packs or conventional AC power, through a transformer if needed, will serve the need. FIG. 1 illustrates the use of a manually closable, normally open switch 20 in series with a battery 22. Closing the switch 20 will start the transmission of an RF signal in a controlled, unique mode as dictated by the modulation unit 18.

The second component of the present invention as shown in FIG. 1 is the receiving unit 12. The receiving unit 12 is sold to the general public and is designed to be carried in a private automobile. The receiving unit 12 includes a radio receiver 24 and antenna 26 to receive any signal from the transmitting unit 10. The radio receiver 24 may be powered by a vehicle battery 28 or may carry its own battery in a self-contained case. The battery is connected to the receiver 24 through a normally open switch 30 which should be closed whenever the vehicle in which it is mounted is in motion. This places the receiver 24 in condition to receive RF signals from the transmitter 14.

A signal from the receiver 24, such as the wave form of FIG. 3, is connected to the base of a transistor 32 through an input resistor 34. The collector of transistor 32 is connected to a voltage supply such as a conventional +12 volt supply. The emitter of the transistor 32 is connected through resistors 36 and 38 to the base of a second transistor 40 which acts as a driver. The emitter of transmitter 40 is connected to ground. The collector of transistor 40 is connected to a speaker 42. Connected in series with the speaker 42 is a light bulb 44 which is also connected to the voltage supply to complete the circuit. An audio frequency circuit 46 is connected in a positive feedback loop between the base and emitter of transistor 32. The audio frequency circuit 46 includes an inductor or coil 48 whose output is connected on the downstream side of resistor 36. A first capacitor 50 is connected in parallel with coil 48. A second capacitor 52 is connected in series with the coil 48 and capacitor 50 and to the base of transistor 32. This circuit is completed by a variable resistor 54 connected in parallel with the speaker 42.

Figure 5:
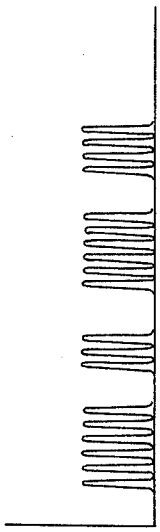
FIG. 5 illustrates the code of FIG. 3 as further modulated at an audio frequency.

In operation, the transistor 32 is off until it receives a signal from the receiver 24. This signal switches transistor 32 on and off in synchronism with its pulse length. This code is applied to the light 44, since the on and off cycling of transistor 32 will be duplicated by the driver transistor 40. This will allow current to flow to the light 44 and it will flash on and off in synchronism with the input code. It is now important to consider the function of of the audio frequency circuit 46. This circuit will cause the actual output of transistor 32 to oscillate at its preselected audio frequency. Thus, the input signal will be further modulated as shown schematically by the wave form of FIG. 5. This modulation is too fast to be seen by the eye, so the light will be on and off, visually, at a rate corresponding to the input code. The rapid oscillation also means that the effective voltage to the light 44 is only one-half of the available twelve volts, and a six volt light must be used for this reason. Most importantly, the oscillator circuit 46 provides an audio frequency signal to drive the speaker 42 in synchronism with the pulse length coded signal. As one example, if the circuit 46 is set for 3.5 KHz, the speaker 42 will give an audible alarm of the coded, unique identification signal at a frequency of 3.5 KHz. The variable resistor 54 allows operator control of the loudness of the speaker 42. If the resistor 54 is set to a low resistance, most of the signal will be shorted through it, and the speaker 42 output tone will have little power or loudness. Conversely, setting the resistor 54 at maximum resistance will give maximum loudness from speaker 42. Since the speaker is being driven with the 3.5 KHz AC component of the output of transistor 40 and the lamp 44 with the DC average value of this output, the lamp 44 brightness remains approximately constant despite adjustment of the loudness level of the speaker 42. Observe again that FIG. 5 illustrates, schematically, that the pulse length coded signal from the receiver 24 is modulated by the 3.5 KHz oscillation from the audio frequency circuit 46. The wave form of FIG. 3 is oscillated rapidly during each "on" cycle to give the wave form of FIG. 5.

Testing of this system has been carried out at a radio frequency in the range of 27 KHz. The specific frequency used is not a critical factor, but the frequency and broadcast power need to be tailored to provide a sufficient range of coverage, but not blanket too wide an area with a driver alerting signal. The present units with the stated frequency and a broadcast power of about 0.1 watt have a range of approximately 1000 feet under urban conditions. This range is, of course, dependent upon the terrain and would be greater in open country.

What I claim is:

1. In a warning system to enable drivers of vehicles to be alerted to the presence of road hazards, the combination which comprises:

transmitter means associated with said road hazards for transmitting a pulse length coded radio frequency signal that is unique for each particular road hazard;

receiver means carried by said vehicles for receiving said pulse length coded signal;

audio frequency generator means, comprising an audio frequency circuit connected in a feedback loop of a transistor amplifier, connected with said receiver means for further modulating said pulse length coded signal at an audio frequency, the period of oscillation of said audio frequency circuit serving to modulate said pulse length coded signal without disturbing said pulse length code;

a visible light emitting means connected to the output of said audio frequency generator means for flashing in synchronism with said pulse length code signal from said transmitter; and an audible sound emitting means connected in series with said visible light emitting means for sounding an audible warning at the frequency set by said audio frequency generator means and in synchronism with said pulse length code from said transmitter means.

2. The system of claim 1 wherein said audio frequency generator means includes:

a transistor having a base connected to said receiver means for receiving said pulse length coded signal, a collector connected to a power supply, and an emitter, said visible light emitting means and said audible sound emitting means being connected in series between said collector and said emitter; and an audio frequency circuit connected in a feedback loop between the emitter and the base of said transistor, the period of oscillation of said audio frequency circuit serving to modulate said pulse length code at an audio frequency without disturbing the continuity of said code.

3. The system of claim 1 which further includes:

variable resistance means connected in parallel with said audible sound emitting means, said variable resistance means being variable to allow more or less of the power of said audio frequency pulse length coded signal to pass through said audible sound emitting means to thereby vary the output volume of said audible sound emitting means.

* * * * *